US007731530B2

(12) United States Patent
Takahashi

(10) Patent No.: US 7,731,530 B2
(45) Date of Patent: Jun. 8, 2010

(54) WATERPROOF PLUG FOR CONNECTOR, WATERPROOF CONNECTOR COMPRISING THE SAME AND METHOD OF ATTACHING THE SAME

(75) Inventor: Shinji Takahashi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 12/263,408

(22) Filed: Oct. 31, 2008

(65) Prior Publication Data

US 2009/0124123 A1 May 14, 2009

(30) Foreign Application Priority Data

Nov. 9, 2007 (JP) ..... 2007-291476

(51) Int. Cl.
*H01R 13/40* (2006.01)

(52) U.S. Cl. ..... 439/587; 439/449

(58) Field of Classification Search ..... 439/449, 439/460, 465–468, 586–589
See application file for complete search history.

(56) References Cited

U.S. PATENT DOCUMENTS

| | | | |
|---|---|---|---|
| 5,675,124 | A | 10/1997 | Stough et al. |
| 2004/0029442 | A1 | 2/2004 | Oka |
| 2005/0106916 | A1 | 5/2005 | Nomura |

FOREIGN PATENT DOCUMENTS

| | | | |
|---|---|---|---|
| EP | 1 251 600 | A1 | 10/2002 |
| GB | 2 135 140 | A | 8/1984 |
| JP | 2005-129460 | A | 5/2005 |

OTHER PUBLICATIONS

European Search Report dated Mar. 10, 2009 from corresponding European Patent Application No. EP 08 16 8307.

*Primary Examiner*—Khiem Nguyen
(74) *Attorney, Agent, or Firm*—Roberts Mlotkowski Safran & Cole, P.C.; Thomas W. Cole

(57) ABSTRACT

A waterproof plug for a connector, includes an elastically deformable seal member for sealing a housing which houses terminals fixed at edges of electric cables in the inside thereof. The seal member is housed inside the housing by press-fitting, and has at least two elements holding the electric cables by sandwiching from both sides and tightly contacting with outer peripheral surfaces thereof.

5 Claims, 5 Drawing Sheets

(a)

(b)

WATERPROOF PLUG FOR CONNECTOR, WATERPROOF CONNECTOR COMPRISING THE SAME AND METHOD OF ATTACHING THE SAME

The present application is based on Japanese Patent Application No. 2007-291476 filed on Nov. 9, 2007, the entire contents of which are incorporated herein by reference.

BACKGROUND OF THE INVENTION

1. Field of the Invention

The present invention relates to a waterproof plug for a connector and a waterproof connector comprising the same, in more particular, to a waterproof plug for a connector for sealing a housing which houses a terminal, a waterproof connector comprising the same and a method of attaching the same.

2. Related Art

There is a conventional waterproof connector comprising a terminal fixed at an edge of an electric cable, a housing for housing this terminal in the inside thereof, a seal member as a waterproof plug for sealing (liquid seal) this housing and a holder for holding the electric cable by positioning the seal member inside the housing (for example, disclosed by JP-A 2005-129460).

The terminal has a projection (a stabilizer) for preventing a reverse insertion and is locked inside the housing.

The housing has a locking portion for locking the terminal and a guide for guiding the stabilizer, and is configured to open on a cable insertion side and an external terminal connection side for housing a portion of the electric cable, the seal member and the holder with the terminal in the inside thereof.

The seal member has a through hole allowing the press-fitting of the terminal and the electric cable, is housed in a state of being pressed against the inside of the housing and is entirely formed of a soft elastic material such as, for example, rubber or the like.

The holder has a through hole letting through the electric cable and is mounted inside the housing. And it is configured to be positioned at a predetermined position by pressing the seal member from the cable insertion side to the external terminal connection side when inserting the holder into the housing.

From the above-mentioned configuration, the waterproof connector is attached by inserting the seal member into the housing from the opening on the cable insertion side so as to be placed at a predetermined position, sequentially placing the holder on the cable insertion side of the seal member, subsequently passing the electric cable through by inserting the terminal into a through hole of the holder and that of the seal member, and pressing the seal member in a thickness direction thereof by moving the holder from the cable insertion side to the external terminal connection side after locking the terminal to the locking portion inside the housing.

In this case, when the seal member receives pressure from the holder, the seal member is compressed in the thickness direction thereof and expands in a direction to press against an inner surface of the housing, thereby sealing the opening of the housing (an opening on the cable insertion side).

However, according to the conventional waterproof connector, there is a possibility that sealing performance deteriorates as the seal member is damaged by the stabilizer of the terminal which scratches an inner periphery of the through hole of the seal member when passing the electric cable through the through hole of the sealing member.

THE SUMMARY OF THE INVENTION

Therefore, it is an object of the invention to provide a waterproof plug for a connector which can prevent damage to a seal member resulting that good sealing performance is obtained, a waterproof connector comprising the same and a method of attaching the same.

(1) According to the present invention, a waterproof plug for a connector, comprising:

an elastically deformable seal member for sealing a housing which houses terminals fixed at edges of electric cables in the inside thereof, wherein the seal member is housed inside the housing by press-fitting, and has at least two elements holding the electric cables by sandwiching from both sides and tightly contacting with outer peripheral surfaces thereof.

(2) In the waterproof plug for a connector described in the above-mentioned (1), the at least two elements have first sealing surfaces fitting to an inner surface of the housing, second sealing surfaces fitting to the outer peripheral surfaces of the electric cable and third sealing surfaces connecting to the second sealing surfaces.

(3) In the waterproof plug for a connector described in the above-mentioned (2), the first sealing surfaces of the at least two elements have projections pressing against the inner surface of the housing.

(4) In the waterproof plug for a connector described in the above-mentioned (2), the second sealing surfaces of the at least two elements are formed of inner peripheral surfaces having a curvature substantially same as that of the outer peripheral surface of the electric cables.

(5) In the waterproof plug for a connector described in the above-mentioned (2), the third sealing surfaces of the at least two elements are formed of substantially flat surfaces pressing against each other in a state that the seal member is housed in the housing.

(6) In the waterproof plug for a connector described in the above-mentioned (2), the third sealing surfaces of the at least two elements are formed of concave-convex surfaces in a corrugated shape.

(7) According to the present invention, a waterproof plug for a connector for sealing a housing to house terminals fixed at edges of electric cables, comprising:

an elastically deformable seal member housed in the housing by press-fitting, and having at least two elements which hold the electric cables by sandwiching from both sides and tightly contact with outer peripheral surfaces thereof; and hinges for coupling the at least two elements so that the seal member is developable and foldable, and for forming through holes between the at least two elements for letting through the electric cables by inserting the terminals.

(8) In the waterproof plug for a connector described in the above-mentioned (7), the hinge is formed by a single member having a through hole letting through the electric cable.

(9) According to the present invention, a waterproof connector, comprising:

terminals fixed at edges of an electric cables;

a housing to house the terminals in the inside thereof; and a waterproof plug for a connector for sealing the housing, wherein the waterproof plug for a connector comprises;

a seal member housed in the housing by press-fitting, and having at least two elements which hold the electric cables by sandwiching from both sides and tightly contact with outer peripheral surfaces thereof; and hinges for coupling the at least two elements so that the seal member is developable and foldable, and for forming through holes between the at least two elements for letting through the electric cables by inserting the terminals.

(10) According to the present invention, a method of attaching a waterproof connector including terminals fixed at an edges of electric cables, a housing to house the terminals in the inside thereof and a waterproof plug for a connector having two elements for sealing the housing, the method comprising:

a first step for attaching the electric cables to the waterproof plug for a connector, and a second step for inserting the terminals into the housing and positioning the waterproof plug for a connector by press fitting, wherein the electric cables are held from both sides by the two elements; and the two elements tightly contact with the outer peripheral surfaces of the electric cables when attaching the electric cables to the waterproof plug for a connector in the first step.

EFFECT OF THE INVENTION

According to present invention, it is possible to prevent damage to a seal member resulting that good sealing performance can be obtained.

BRIEF DESCRIPTION OF THE DRAWINGS

Next, the present invention will be explained in more detail in conjunction with appended drawings, wherein.

DESCRIPTION OF THE PREFERRED EMBODIMENT

Preferred Embodiment

Figure 1:
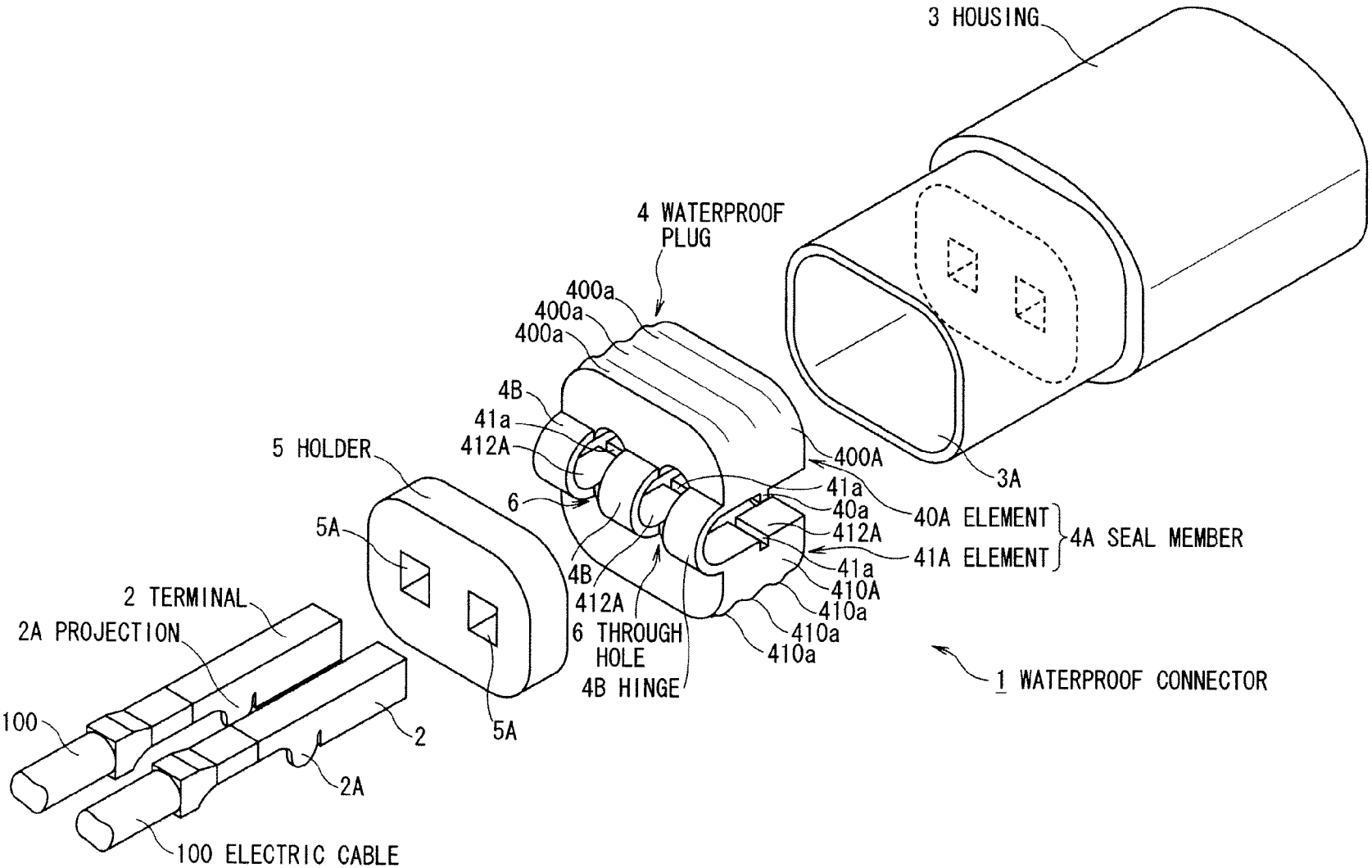
FIG. 1 is an exploded perspective view shown for explaining the entire waterproof connector in a preferred embodiment according to the present invention.
Figure 2:
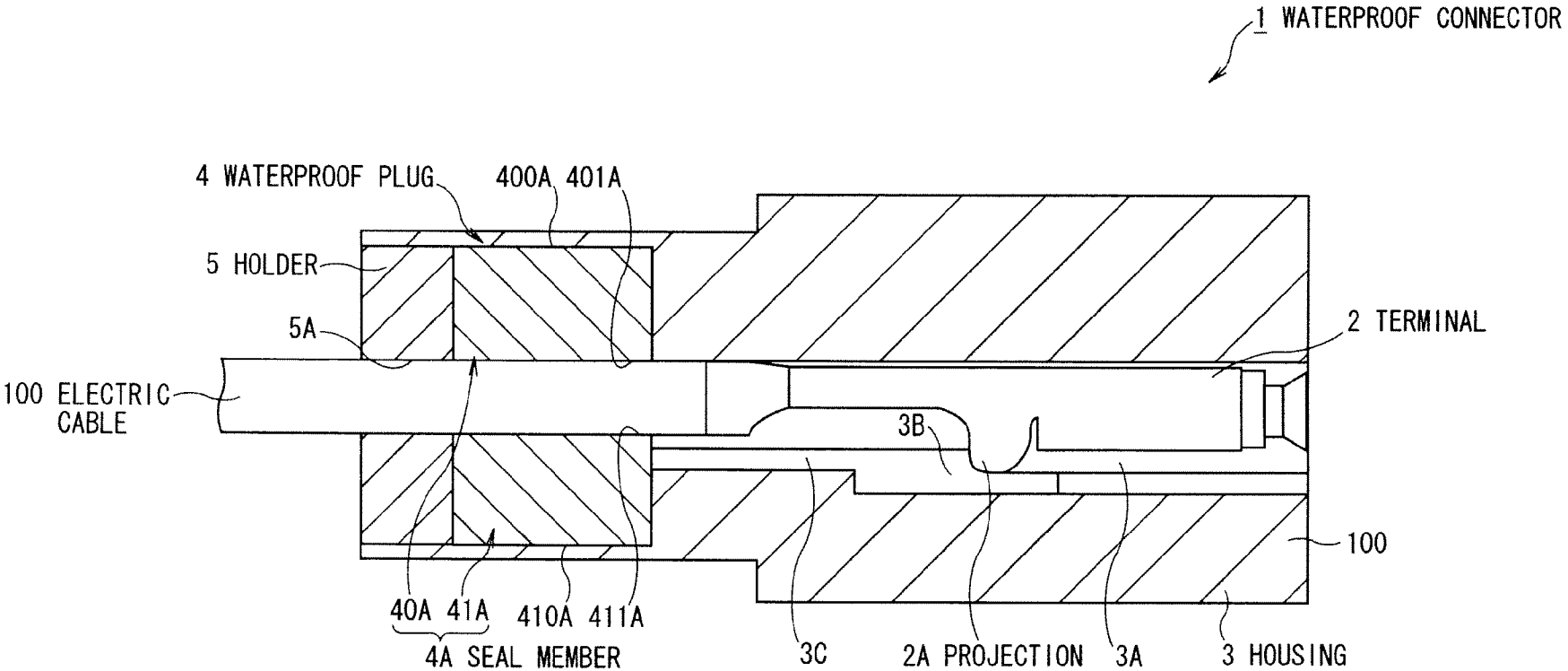
FIG. 2 is a vertical cross-sectional view shown for explaining the entire waterproof connector in the preferred embodiment according to the present invention.
Figure 3:
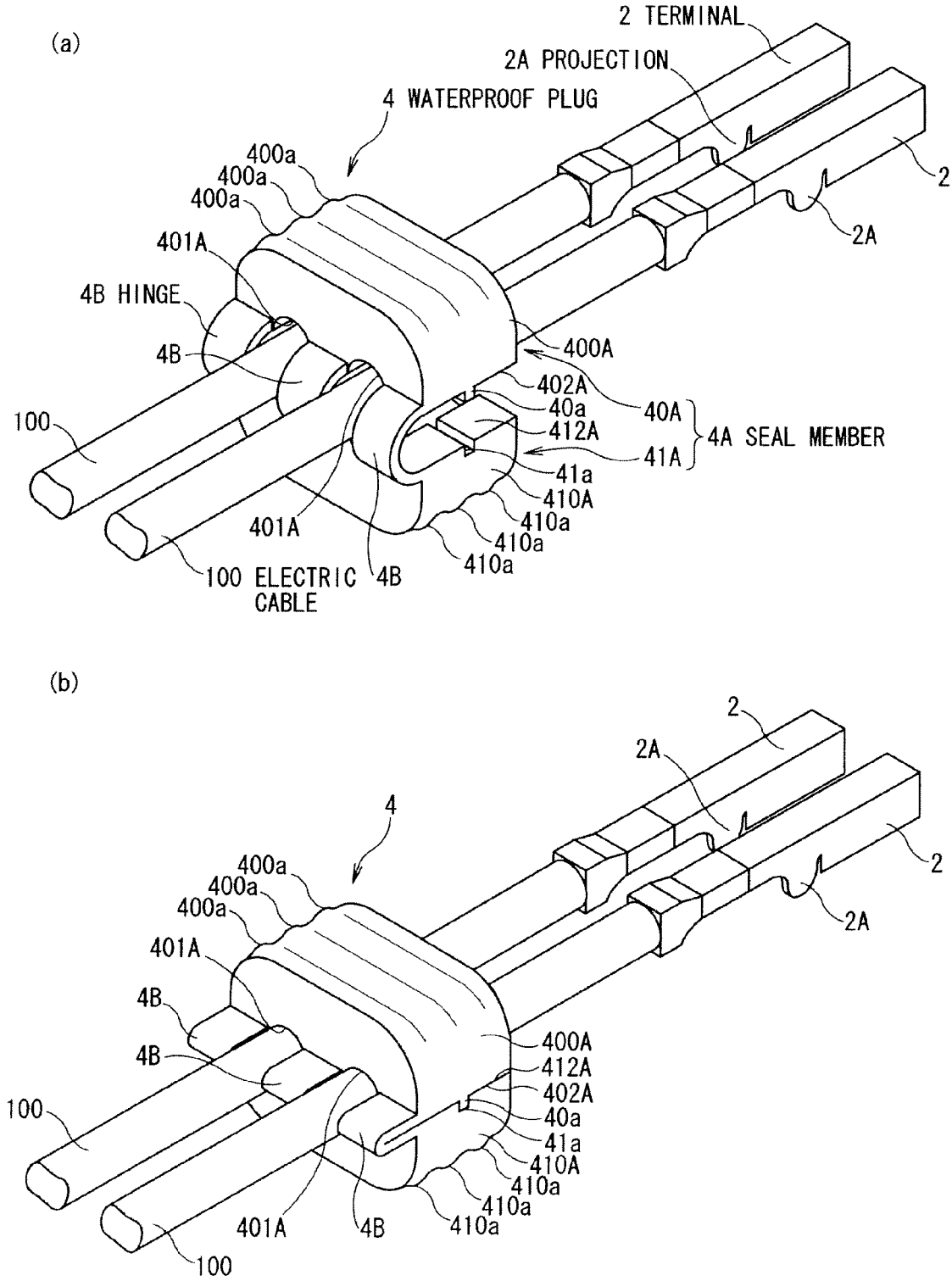
FIGS. 3A and 3B are perspective views shown for explaining an attached state of the electric cable into the waterproof plug of the waterproof connector in the preferred embodiment according to the present invention.
Figure 4:
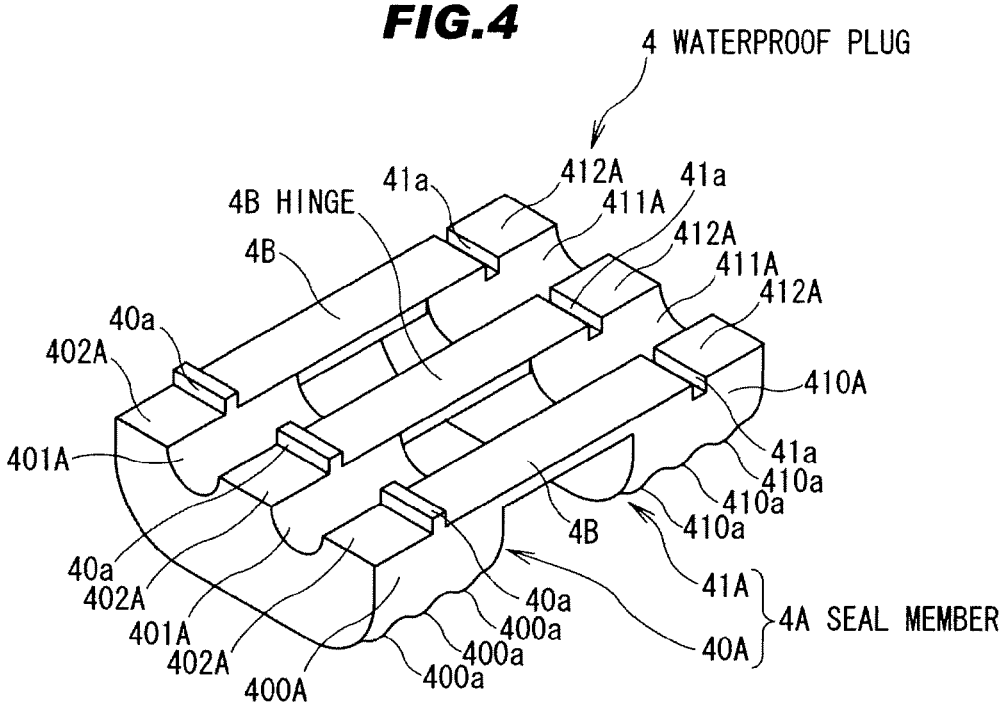
FIGS. 4A and 4B are perspective views showing the waterproof plug of the waterproof connector in the preferred embodiment according to the present invention.
Figure 4:
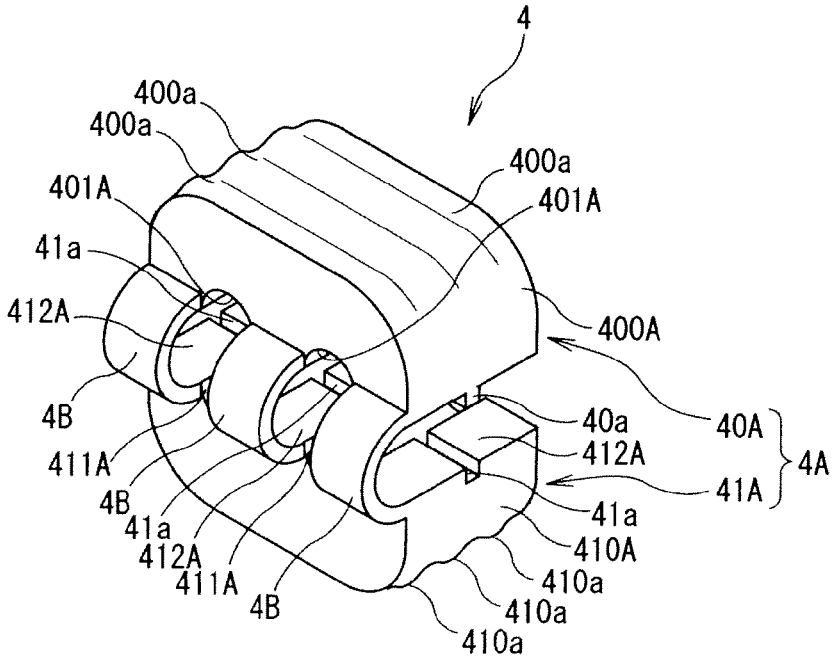

FIG. 1 is an exploded perspective view shown for explaining the entire waterproof connector in a preferred embodiment according to the present invention. FIG. 2 is a vertical cross-sectional view shown for explaining the entire waterproof connector in the preferred embodiment according to the present invention. FIGS. 3A and 3B are perspective views shown for explaining an attached state of the electric cable into the waterproof plug of the waterproof connector in the preferred embodiment according to the present invention, wherein FIG. 3A shows a developed state of the waterproof plug and FIG. 3B shows a folded state of the waterproof plug, respectively. FIGS. 4A and 4B are perspective views showing the waterproof plug of the waterproof connector in the preferred embodiment according to the present invention wherein FIG. 4A shows a developed state of the waterproof plug and FIG. 4B shows a folded state of the waterproof plug, respectively.

(Overall Structure of the Waterproof Connector)

In FIG. 1 and FIG. 2, a waterproof connector indicated by a reference numeral 1 is schematically configured to comprise terminals 2,2 crimpingly fixed at edges of electrical cables 100,100 respectively, a housing 3 for housing these terminals 2,2 in the inside thereof, a waterproof plug 4 for sealing (liquid seal) this housing 3 and a holder 5 for holding the electrical cables 100,100 by positioning this waterproof plug 4 inside the housing 3.

(Structure of the Terminals 2,2)

As shown in FIG. 1 and FIG. 2, the respective terminals 2,2 have projections (stabilizers) 2A, 2A for preventing a reverse insertion and are locked inside the housing 3. And the entire terminal 2 is formed of a conductive member such as metal or the like.

(Structure of the Housing 3)

As shown in FIG. 1 and FIG. 2, the housing 3 has a housing space 3A opening on a cable insertion side and an external terminal connection side for housing a portion of the electric cables 100,100, the waterproof plug 4 and the holder 5 with the terminals 2,2, and is entirely formed of an insulating member such as an epoxy resin or the like. Locking portions 3B,3B for locking the terminals 2,2 and guides 3C,3C for guiding the stabilizers 2A,2A are arranged in the housing space 3A of the housing 3.

(Structure of the Waterproof Plug 4)

As shown in FIGS. 3A, 3B, 4A and 4B, the waterproof plug 4 comprises a seal member 4A and hinges 4B,4B . . . (three hinges in this embodiment), and is housed on the cable insertion side of the housing space 3A in the housing 3.

The seal member 4A has a pair of elements 40A and 41A holding the electric cables 100,100 sandwiching from both sides and tightly contacting with the outer peripheral surfaces thereof, and is housed in a state of being pressed against the inside of the housing 3. For a material of the seal member 4A (the elements 40A and 41A), a soft elastic material composed of plastic rubber such as, for example, silicon rubber, acrylic rubber or the like is used.

The elements 40A and 41A have first sealing surfaces 400A and 410A fitting to the inner surface of the housing 3, second sealing surfaces 401A and 411A fitting to the outer peripheral surfaces of the electric cables 100,100 respectively and third sealing surfaces 402A and 412A connecting to the second sealing surfaces 401A and 411A respectively, and are entirely formed by curved-surface bodies. Two of second sealing surfaces 401A and two of second sealing surfaces 411A are arranged in the elements 40A and 41A respectively, and three of third sealing surfaces 402A and three of third sealing surfaces 412A are arranged in the elements 40A and 41A respectively.

The element 40A is provided with convex portions 40*a*, 40*a* . . . (three convex portions in this embodiment) located at a portion adjacent to the hinges 4B,4B and projecting from the third sealing surfaces 402A,402A. Concave portions 41*a*, 41*a* . . . for engaging with the convex portions 40*a*,40*a* . . . respectively are provided on the element 41A. One element 40A is locked to another element 41A in a state that the convex portions 40*a*,40*a* . . . are engaged with the concave portions 41*a*,41*a* . . . .

The first sealing surfaces 400A and 410A are formed of two substantially flat surfaces pressing against the housing 3 and smooth curved surfaces intermediating between these two flat surfaces in a state that the seal member 4A is housed in the housing 3. A plurality of projections 400*a*,400*a* . . . and projections 410*a*,410*a* . . . , which are parallel in a cable insertion direction with respect to the housing 3, are integrally provided on the curved surfaces of the first sealing surfaces 400A and 410A. As a result, since the projections 400*a*, 400*a* . . . and the projections 410*a*,410*a* . . . are pressed against the inner surface of the housing 3 in the state that the seal member 4A is housed in the housing 3, the sealing between the inner surface of the housing 3 and the curved surface of the first sealing surfaces 400A and 410A are effectively carried out.

The second sealing surfaces 401A and 411A (there are two surfaces, respectively) are formed of inner peripheral surfaces having curvature substantially same as that of outer peripheral surfaces of the electric cables 100,100. And the second sealing surfaces 401A and 411A are configured to press against each other via the electric cables 100,100 respectively in the state that the seal member 4A is housed in the housing 3.

The third sealing surfaces 402A and 412A (there are three surfaces, respectively) are formed of substantially flat surfaces which face each other in a state that the seal member 4A is folded. And the third sealing surfaces 402A and 412A are configured to press against each other in the state that the seal member 4A is housed in the housing 3.

The hinges 4B,4B are aligned in parallel in a width direction of the elements 40A and 41A at a predetermined interval, are integrally provided at edges of the cable insertion side of the elements 40A and 41A, and are entirely formed of a belt-like member having flexibility. And the hinges 4B, 4B . . . are configured to couple the elements 40A and 41A so that the seal member 4A is developable as shown in FIGS. 3A and 4A as well as foldable as shown in FIGS. 3B and 4B. Furthermore, as shown in FIG. 1, the hinges 4B,4B . . . are configured to form through holes 6,6 between the elements 40A and 41A for letting through the electric cables 100,100 by inserting the terminals 2,2. Namely, the through holes 6,6 are arranged between two hinges 4B,4B adjacent to each other among the hinges 4B,4B . . . .

The thickness of the hinges 4B,4B is set to be smaller than that of the elements 40A and 41A. A distance between the hinges 4B,4B adjacent to each other among the hinges 4B, 4B . . . and a distance between the elements 40A and 41A (a hinge length) are set so as to let through the electric cables 100,100 by inserting the terminals 2,2 into the through holes 6,6 respectively without damaging the waterproof plug 4 (the seal member 4A and the hinges 4B,4B . . . ) in a state that the seal member 4A is developed.

(Structure of the Holder 5)

As shown in FIG. 1 and FIG. 2, the holder 5 has through holes 5A,5A for letting through the electric cables 100 and is mounted by being inserted into the housing 3. And the holder 5 is configured to position the waterproof plug 4, in which the electric cables 100,100 are preliminarily held from both sides by the elements 40A and 41A, and the terminals 2,2 preliminarily fixed at the edge of the electric cables 100,100 at a predetermined position by pressing from the cable insertion side to the external terminal connection side of the housing 3 when inserting the holder 5 into the housing 3. The holder 5 is provided with concave portions (not shown) for housing the hinges 4B,4B . . . in the state that the waterproof plug 4 is housed in the housing 3.

(Method of Attaching the Waterproof Connector)

Figure 5:
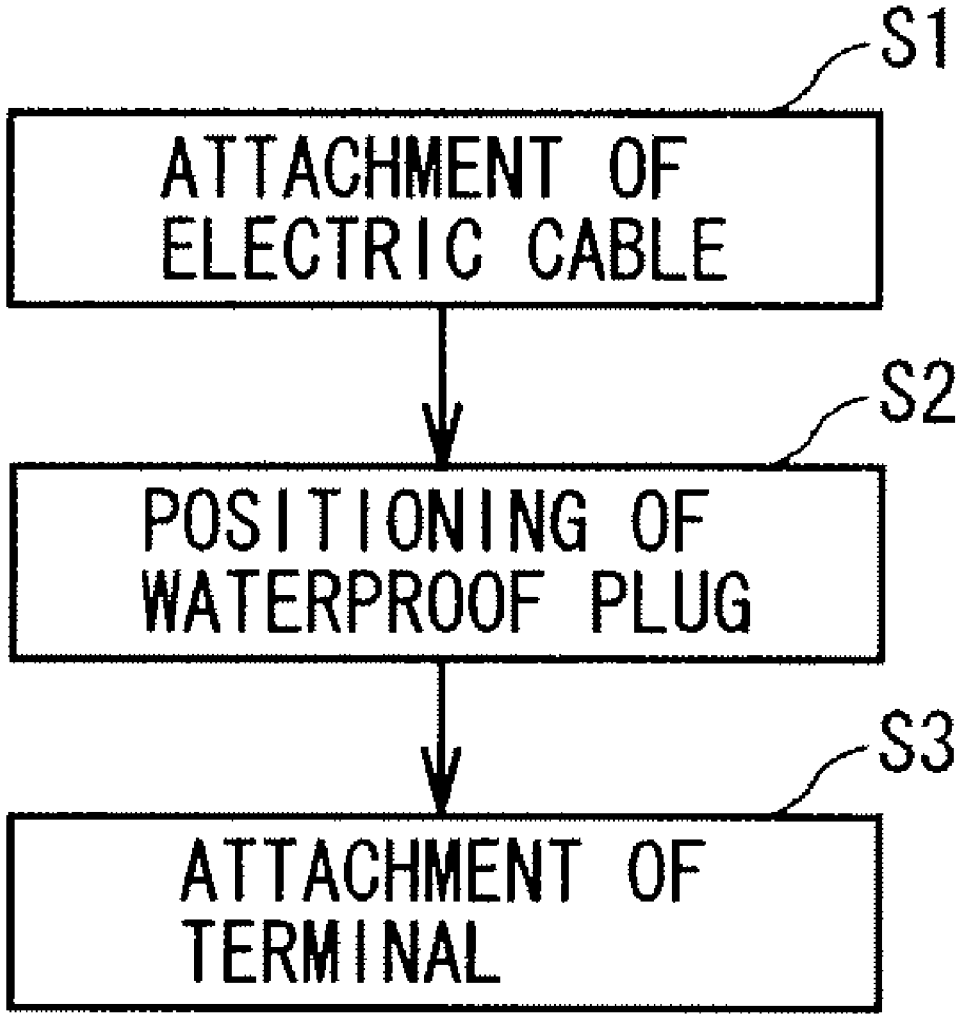
FIG. 5 is a flow chart shown for explaining a method of attaching the waterproof connector in the preferred embodiment according to the present invention.

A method of attaching the waterproof connector in this preferred embodiment according to the present invention will be explained referring to FIG. 5. FIG. 5 is a flow chart shown for explaining a method of attaching the waterproof connector in the preferred embodiment according to the present invention.

Since each process of "attachment of electric cable", "positioning of waterproof plug" and "attachment of terminal" is sequentially implemented in the method of attaching the waterproof connector shown in this preferred embodiment, the each process will be sequentially explained. Note that, the terminals 2,2 are crimpingly fixed at the edges of the electric cables 100,100, respectively.

"Attachment of the Electric Cables"

Firstly, the electric cables are passed through the through holes 5A,5A of the holder 5 respectively by inserting the terminals 2,2.

Next, in the state that the seal member 4A of the waterproof plug 4 is preliminarily developed, the electric cables 100,100 are passed through the through holes 6,6 between the elements 40A and 41A by inserting the terminals 2,2 respectively, and are mounted by engaging with the second sealing surfaces 411A,411A of the element 41A.

After that, the seal member 4A is folded by bending the hinges 4B,4B . . . so as to engage the electric cables 100,100 with the second sealing surfaces 411A,411A of the element 40A and to lock the element 40A to the element 41A by engaging the convex portions 40*a*,40*a* . . . of the element 40A with the concave portions 41*a*,41*a* . . . of the element 41A respectively.

In this case, when the element 40A is locked to the element 41A, the electric cables 100,100 are held from both sides by the elements 40A and 41A. Therefore, since the second sealing surfaces 411A,411A of the element 41A and the second sealing surfaces 401A,401A of the element 40A are pressed against each other via the electric cables 100,100, the second sealing surfaces 401A,401A and the second sealing surfaces 411A,411A tightly contact with the outer peripheral surfaces of the electric cables 100,100, respectively. Furthermore, the third sealing surfaces 412A,412A of the element 41A and the third sealing surfaces 402A,402A of the element 40A tightly contact with each other. As a result, the electric cables 100, 100 are attached to (assembled with) the seal member 4A (the waterproof plug 4) (step S1 in FIG. 5).

"Positioning of the Waterproof Plug"

The terminals 2,2 are inserted into the housing 3 from the cable insertion side toward the external terminal connection side so as to be arranged on the cable insertion side of the housing 3 (the housing space 3A) by press-fitting of the waterproof plug 4 in which the electric cables 100,100 have been attached to the seal member 4A in the step S1 of FIG. 5. In this case, when the waterproof plug 4 is arranged on the cable insertion side of the housing 3, the waterproof plug 4 is positioned in a surface direction orthogonal to a press-fitting direction thereof (step S2 in FIG. 5).

"Attachment of the Terminal"

The holder 5 is arranged at a predetermined position moved with the terminals 2,2 pressing the waterproof plug 4 from the from the cable insertion side toward the external terminal connection side by an insertion of the holder 5 into the housing 3. In this case, the waterproof plug 4 is moved while maintaining the state that the first sealing surface 400A (the projections 400*a*,400*a* . . . ) of the element 40A and the first sealing surface 410 (the projections 410*a*,410*a* . . . ) of the element 41A are pressed against the inner surface of the housing 3. Furthermore, the terminals 2,2 are moved by guiding the stabilizer 2A,2A by the guides 3C,3C. Then, after the waterproof plug 4 is arranged at a predetermined position, the terminals 2,2 are attached inside the housing 3 by the locking of the locking portions 3B,3B (step S3 in FIG. 5).

Effect of the Preferred Embodiment

According to the preferred embodiment described above, following effects can be obtained.

(1) It is possible to prevent damage to the seal member 4A at the time of attaching the waterproof connector 1, resulting that good sealing performance can be obtained.

(2) Since the element 40A and the element 41A are coupled via the hinges 4B,4B . . . , it is possible to form the waterproof plug 4 from a single piece similarly to the conventional plug.

Although the waterproof connector according to the present invention has been described based on the above preferred embodiment, the invention is not limited by the above preferred embodiment and it is possible to implement in various features without going beyond a scope of the concept. For example, following variation can be made.

(1) In this preferred embodiment, although it is explained that the hinges 4B,4B are provided in parallel in a width direction of the element between the elements 40A and 41A and the through holes 6,6 are provided between two hinges 4B,4B adjacent to each other among the hinges 4B,4B . . . , the present invention is not limited thereto, a single hinge may be provided between a pair of elements providing a through hole to pass the electric cable through this hinge.

(2) In this preferred embodiment, although it is explained that the second sealing surfaces 401A,401A of the element 40A and the second sealing surfaces 411A,411A of the element 41A are formed of inner peripheral surfaces having a curvature substantially same as that of the outer peripheral surfaces of the electric cables 100,100, the present invention is not limited thereto, opening shape formed by the second sealing surfaces of both elements may be, for example, a rectangular shape having an opening space smaller than a cross-section area of the electric cable.

(3) In this preferred embodiment, although it is explained that the hinges 4B,4B . . . are arranged at an edge of the cable insertion side of the elements 40A and 41A, the present invention is not limited thereto, hinges may be arranged at an edge of the external terminal connection side (an edge opposite to the edge of the cable insertion side).

(4) In this preferred embodiment, although it is explained that a pair of electric cables 100,100 are provided in parallel in a width direction of the element between the elements 40A and 41A, the present invention is not limited thereto, three or more electric cables may be arranged, of course.

(5) In this preferred embodiment, although it is explained that the elements 40A and 41A are made in two tiers (one pair) in a thickness direction of the element in the folded state of the waterproof plug 4, the present invention is not limited thereto, the element may be made in three or more tiers. In this case, two elements adjacent to each other among multiple elements are coupled by the hinges so as to fold the seal member staggerly.

(6) In this preferred embodiment, although it is explained that the third sealing surfaces 402A and 412A are formed by flat surfaces having the convex portion 41*a* and the concave portion 41*a* respectively, the present invention is not limited thereto, each third sealing surface may be formed by a concave-convex surface in a corrugated shape. In this case, each third sealing surface is formed by a concave-convex surface in a corrugated shape, and in addition to this, an outer peripheral surface of the covered portion in the electric cable may be formed by a concave-convex surface in a corrugated shape.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A waterproof plug for a connector, comprising:

an elastically deformable seal member for sealing a housing which houses terminals fixed at edges of electric cables in the inside thereof; wherein the seal member is housed inside the housing by press-fitting, and has at least two elements holding the electric cables by sandwiching from both sides and tightly contacting with outer peripheral surfaces thereof, and wherein the at least two elements have first sealing surfaces fitting to an inner surface of the housing, second sealing surfaces fitting to the outer peripheral surfaces of the electric cable and third sealing surfaces connecting to the second sealing surfaces, and the second sealing surfaces of the at least two elements being formed of continuous inner peripheral surfaces having a curvature substantially the same as that of the outer peripheral surfaces of the electric cables.

2. The waterproof plug for a connector according to claim 1, wherein the third sealing surfaces of the at least two elements are formed of substantially flat surfaces pressing against each other in a state that the seal member is housed in the housing.

3. The waterproof plug for a connector according to claim 2, wherein the third sealing surfaces of the at least two elements are formed of concave-convex surfaces in a corrugated shape.

4. The waterproof plug for a connector according to claim 2, wherein the seal member has hinges for coupling the at least two elements so that the seal member is developable and foldable, and for forming through holes between the at least two elements for letting through the electric cables by inserting the cables.

5. The waterproof plug for a connector according to claim 4, wherein the hinge is formed by a single member having a through hole letting through the electric cable.

* * * * *